US010161203B2

(12) United States Patent
Hassard et al.

(10) Patent No.: US 10,161,203 B2
(45) Date of Patent: Dec. 25, 2018

(54) SPLIT CARRIER BLOCK AND METHOD

(71) Applicant: SCB Energy, LLP, Pine, CO (US)

(72) Inventors: Cecil C. Hassard, Calgary (CA); Robert Merkin, Morrison, CO (US); Bryan Collier, Pine, CO (US)

(73) Assignee: SCB Energy, LLP, Pine, CO (US)

( * ) Notice: Subject to any disclaimer, the term of this patent is extended or adjusted under 35 U.S.C. 154(b) by 436 days.

(21) Appl. No.: 14/631,571

(22) Filed: Feb. 25, 2015

(65) Prior Publication Data

US 2015/0240577 A1 Aug. 27, 2015

Related U.S. Application Data

(60) Provisional application No. 61/944,206, filed on Feb. 25, 2014, provisional application No. 62/037,468, filed on Aug. 14, 2014, provisional application No. 62/045,623, filed on Sep. 4, 2014.

(51) Int. Cl.
*E21B 19/22* (2006.01)
*B65H 51/14* (2006.01)

(52) U.S. Cl.
CPC ..... *E21B 19/22* (2013.01); *B65H 51/14* (2013.01); *B65H 2701/33* (2013.01)

(58) Field of Classification Search
CPC ..... E21B 19/22; E21B 19/08; E21B 19/00; E21B 17/20; B65G 37/00; B65G 37/005; B65G 15/10–15/20; B65G 17/002; B65G 17/063; B65G 17/42; B65G 23/00–23/20; Y10T 29/49826; B65H 51/18; B65H 51/14; B65H 2701/33
USPC ..... 198/867.11, 867.12, 867.13, 867.14, 51, 198/852; 166/77.1–77.4; 226/168–173
See application file for complete search history.

(56) References Cited

U.S. PATENT DOCUMENTS

| | | | | |
|---|---|---|---|---|
| 6,059,029 | A | 5/2000 | Goode | |
| 6,216,780 | B1 | 4/2001 | Goode et al. | |
| RE43,410 | E * | 5/2012 | Goode | E21B 19/22 166/77.3 |
| 2002/0046833 | A1* | 4/2002 | Perio, Jr. | E21B 19/22 166/77.3 |
| 2011/0048694 | A1 | 3/2011 | Maschek, Jr. et al. | |

OTHER PUBLICATIONS

International Search Report and Written Opinion dated May 28, 2015, in PCT/US15/017560.
Chinese Office Action dated Jun. 13, 2017, issued in Chinese Application No. 201580050198.
Non-Final Office Action dated Apr. 18, 2018, in Chinese Application No. 2015800050198.
International Preliminary Report on Patentability dated Sep. 6, 2016, in International Application PCT/US15/17560.

* cited by examiner

*Primary Examiner* — George S Gray
(74) *Attorney, Agent, or Firm* — Ramey & Schwaller LLP

(57) ABSTRACT

Methods and apparatuses for mounting and/or removing carrier blocks from coiled tubing injector chains are needed. The carrier blocks are operable for supporting coil tubing grippers. The method and/or apparatus utilizes an assembled coiled tubing injector head chain assembly and/or mounting or removing the carrier blocks with respect to the coiled tubing injector head chain assembly.

12 Claims, 6 Drawing Sheets

SPLIT CARRIER BLOCK AND METHOD

CROSS REFERENCE TO RELATED APPLICATIONS

The following application incorporates U.S. Prov. App. 61/994,206 filed on Feb. 25, 2014; U.S. Prov. App. 62/037,468 filed Aug. 14, 2014; and U.S. Prov. App. 62/045,623 filed on Sep. 4, 2014, the contents of each are incorporated herein in their entirety.

FIELD

The present invention relates generally to carrier blocks for coiled tubing injector heads.

BACKGROUND

In the drilling of oil and gas wells, a wellbore is formed using a drill bit that is urged downwardly at a lower end of a drill string. After drilling a predetermined depth, the drill string and the drill bit are removed, and the wellbore is lined with a string of steel pipe called casing. The casing provides support to the wellbore and facilitates the isolation of certain areas of the wellbore adjacent hydrocarbon bearing formations. An annular area is thus defined between the outside of the casing and the earth formation. This annular area is typically filled with cement to permanently set the casing in the wellbore and to facilitate the isolation of production zones and fluids at different depths within the wellbore. Numerous operations occur in the well before or after the casing is secured in the wellbore. Many operations require the insertion of some type of instrumentation or hardware within the wellbore.

Coiled tubing is a long continuous length of spooled or "reeled" thin walled pipe that can be pushed into a wellbore. This coiled tubing can be used to conduct many different downhole operations in oil and gas wells. For example, coiled tubing can be concentrically inserted into an existing wellbore in order to clean out sand or other debris from such well. Further, conventional coiled tubing can be used to conduct downhole operations by attaching a fluid activated tool to the distal end of the tubing, and then pumping pressurized drilling fluid through the coiled tubing to actuate such tool. For example, in the case of a mud motor and drill bit, the drill bit and hydraulic mud motor are lowered into the borehole as the coiled tubing is spooled off a reel, thereby allowing the borehole to be drilled deeper into subterranean formations.

Coiled tubing is driven downhole by coiled tubing injector heads. Conventionally, coiled tubing injector heads employ motor driven endless chain loops that are supplied with carrier blocks with grippers for creating a strong friction grip against the coiled tubing. As the tubing is fed into the injector head, the gripper blocks press against the coiled tubing, which is mechanically forced into the wellbore as the endless chains of the injector head are turned. The direction of the endless chain loops is reversed to withdraw the tubing from the wellbore. The coiled tubing is conventionally introduced into the wellbore through a seal, which contains the well pressure as the coiled tubing is introduced or withdrawn.

Typically, the coiled tubing injector head is positioned above the wellhead. In workover operations for example, the injector head is often suspended above the wellbore by a crane or other device. A tubing guide may be used to connect the injector head to the wellhead (including, for example, a blowout preventer) at the top of the wellbore to prevent the coiled tubing from buckling or otherwise deforming prior to entering the wellbore.

Conventional injector heads typically utilize specially-adapted chain assemblies to grip the outer surface of the coiled tubing string. The current art requires solid carrier blocks be assembled with hundreds or even thousands of individual chain components on a single injector head. A solid carrier block that becomes worn, cracked or broken necessitates removal and/or replacement of the entire injector chain and conventional solid carrier block assembly.

Problematically, the chains of the injector head are heavy and complex. Removal of the chains for repair in the case of a broken carrier block requires effort on the part of the oil field workers, time for disassembly, time for repair, and time for re-installment. This process can keep the injector head out of commission for many hours or even days. Due to the cost of drilling operations, companies stand to lose large sums of money when an injector head's chains need to be removed for repair. Additionally, due to the heavy nature of the chains and potentially awkward positioning needed for removal and re-installment, oilfield workers are subjected to less than optimal safety conditions.

Therefore, there exists a need to avoid having to remove and disassemble entire injector chains due to one minor problem with a carrier block. The problems described above are answered by using a split carrier block of the present invention.

SUMMARY

Aspects of the present invention pertain to a split carrier block for use with a coiled tubing injector chain. In specific aspects, the split carrier block comprises a first carrier block half comprising a first chain pin component receptacle side and a side facing away from coiled tubing; and a second carrier block half comprising a second chain pin component receptacle side and a side facing the coiled tubing; wherein the first carrier block half and the second carrier block are capable of a releasable fixed connection to at least one chain pin component of the coiled tubing injector chain.

Split carrier blocks are mountable and removable from chain components, such as chain pins, of coiled tubing injector chains without disassembling said coiled tubing injector chains. Further, grippers for coiled tubing are mountable from the split carrier block.

The first carrier block half and said second carrier block half are moveable to a fixed position with respect to each other so that they can be affixed together to fasten these halves to the chain components.

The aspects of the invention further provide for fasteners to selectively affix the first and second carrier block halves together in a fixed position and to selectively allow the first and second carrier block halves to be moveable with respect to each other in the open position.

Still further, concerning the fasteners, the fasteners comprise at least one of: hinges, pins, rivets, threaded members and interlocking sections of the first and second carrier block halves or equivalents thereof.

The aspects of the aforementioned invention further comprise alignment members.

In aspects of the invention concerning alignment members, the alignment members comprise tongue members that mate with corresponding grooves. However, in other embodiments, the alignment members can be a lap joint, pins, dowels, shoulders, overlaps or combinations thereof.

In still further aspects of the invention concerning the carrier block halves, the carrier block halves comprise gripper attachment members that mate with the grippers for mounting the grippers to the carrier block halves when the halves are mated.

Additional embodiments of the invention concern a method of mounting or removing carrier blocks from coiled tubing injector chains. The carrier blocks are capable of supporting coil tubing grippers. The method comprises: providing an assembled coiled tubing injector head chain assembly; and mounting or removing the carrier blocks with respect to the coiled tubing injector head chain assembly.

Other aspects of the aforementioned invention additionally concern using fasteners to affix the carrier blocks to chain components of the coiled tubing injector head chain assembly.

Still other aspects of the aforementioned invention pertain to selectively mounting coiled tubing grippers to the carrier blocks.

Additional aspects of the method of the present invention concern the carrier blocks in which the carrier blocks comprise carrier block halves being selectively mountable to a coiled tubing chain assembly.

Still further concerning the carrier block halves, at least one of the carrier block halves comprises a coiled tubing gripper.

Other aspects of the invention comprise a coiled tubing injector with one or more pairs of split carrier blocks as described above. Still further other aspects of the invention comprise a pair of split carrier blocks as described above which can be mounted to a coiled tubing injector. Still further, other aspects of the invention herein concern a kit comprising one or more of the split carrier blocks described above. Still further other aspects of the invention include a tubing injector comprising at least one pair of said split carrier block.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In order that the manner in which the above-recited and other enhancements and objects of the invention are obtained, we briefly describe a more particular description of the invention briefly rendered by reference to specific embodiments thereof which are illustrated in the appended drawings. Understanding that these drawings depict only typical embodiments of the invention and are therefore not to be considered limiting of its scope, we herein describe the invention with additional specificity and detail through the use of the accompanying drawings in which.

LIST OF REFERENCE NUMERALS

Figure 1:
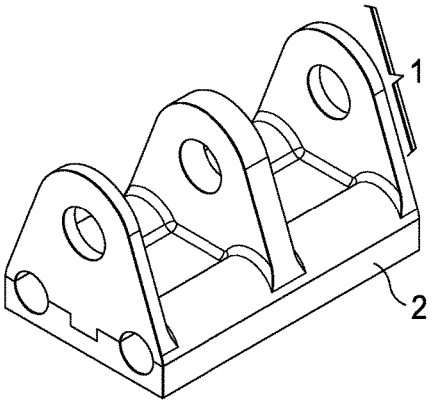
FIG. 1 is perspective view of a split carrier block in accord with one possible embodiment of the present invention.
Figure 2:
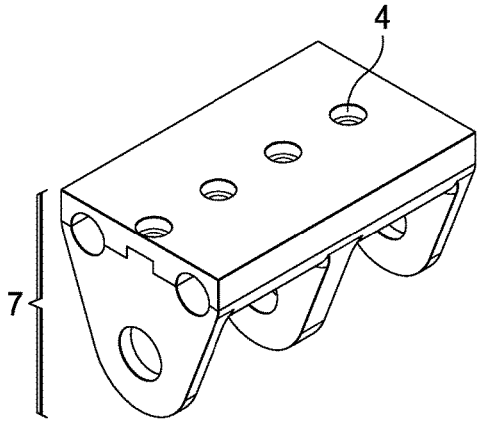
FIG. 2 is an inverted perspective view of the split carrier block from FIG. 1 in accord with one possible embodiment of the present invention.
Figure 3:
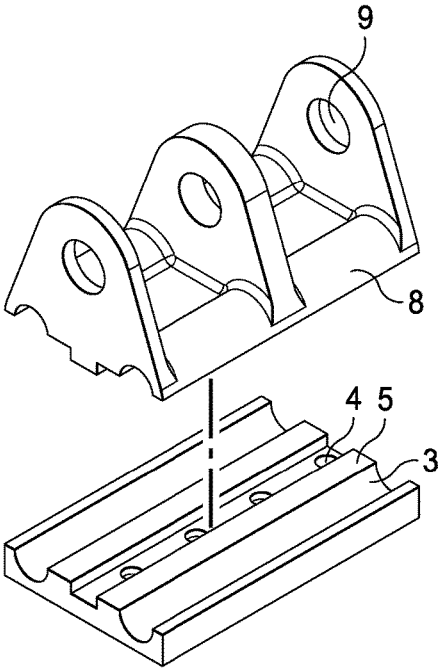
FIG. 3 is an exploded perspective view of the split carrier block from FIG. 1 in accord with one possible embodiment of the present invention.
Figure 4:
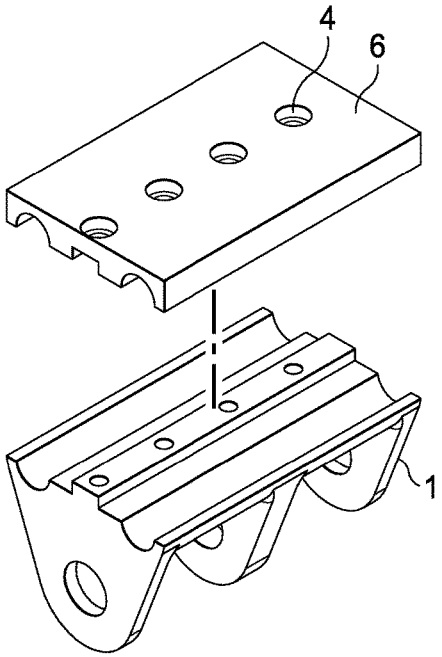
FIG. 4 is an inverted exploded perspective view of the split carrier block from FIG. 1 in accord with one possible embodiment of the present invention.

1 bearing mount carrier block half
2 gripper receiving carrier block half
3 chain pin grooves
4 carrier block bores
5 chain pin face
6 gripper mounting face
7 carrier block
8 bearing mount face
9 bearing mounts
11 bolts
12 gasket
13 gripper
14 coiled tubing side
15 carrier block side
16 non gripper receiving carrier block half
17 short pin carrier block component
17*a* first short pin carrier block component
17*b* second short pin carrier block component
17*c* hex screw
18 bolts to secure the gripper to the split carrier block
19 gripper receiving carrier block half
20 gripper receiving carrier block half

DETAILED DESCRIPTION

Introduction

We show the particulars shown herein by way of example and for purposes of illustrative discussion of the preferred embodiments of the present invention only. We present these particulars to provide what we believe to be the most useful and readily understood description of the principles and conceptual aspects of various embodiments of the invention. In this regard, we make no attempt to show structural details of the invention in more detail than is necessary for the fundamental understanding of the invention. We intend that the description should be taken with the drawings. This should make apparent to those skilled in the art how the several forms of the invention are embodied in practice.

The embodiments of the invention herein pertain to an improved apparatus and methods for mounting and removing carrier blocks used for coiled tubing injector chain assemblies. More specifically, the embodiments disclosed herein provide a split carrier block that is used for coiled tubing injector head chains. The split carrier block concept allows for any type of installation of the carrier block onto or away from pre-assembled injector head chains without the need to remove the chains or pins or other components of the injector head chains.

Still further, in such embodiments, the aforementioned apparatus and methods generally eliminate the need to disassemble the chain assemblies or scrap the used injector chain head. Alternatively or additively, the aforementioned apparatus and methods generally eliminate the need to scrap one or more used carrier blocks.

Still further, certain embodiments of the invention herein pertain to apparatuses and methods for mounting and removing carrier blocks to coiled tubing injector chain assemblies generally without the need to disassemble the chain assemblies or scrap the used injector chain head, or one or more of the used carrier blocks.

Certain embodiments of the invention pertain to a split carrier block apparatus. In such embodiments, the split carrier is mountable or removable from chain pins of coiled tubing injector chains generally without disassembling the coiled tubing injector chains. In such embodiments, grippers for coiled tubing are generally mountable or removable from the split carrier block.

In certain further embodiments, grippers for coiled tubing are mountable or removable from the split carrier block.

In certain embodiments pertaining to the carrier block, the split carrier block has at least two components. One component in this embodiment has an outside face that faces away from the coiled tubing. In certain embodiments, this outside face is adapted for mounting bearings used on injector chains. Another component in this embodiment has an outside face which faces the coiled tubing. This outside face, in many embodiments, is adapted to receive a third component. In certain further embodiments, the third component is a gripper adapted to grip the coiled tubing so that the tubing is pushed downhole or pulled out.

Regarding the first and second component, each of these components has an inside face with grooves, that when aligned with each other, are adapted to receive chain pins of the injector chain. The inside faces of the blocks are generally in contact with each other such that the grooves form substantially circular bores around the chain pins. However, in certain other embodiments, it is conceivable that the faces, while gripping or securing the chain pins, do not completely or do not contact each other.

In the embodiments wherein the first component and second component are adapted to receive chain pins, the components are secured together to prevent the two components from falling off the chain pins via screws, bolts, pins, and the like. In such embodiments, the first component and the second component typically have bores perpendicular to the chain pin through which screws, bolts, rivets, or pins can pass for this aforementioned securement. However, it is conceivable that in certain embodiments the first and second components are secured by a hinge and latch mechanism, are slidably disposed on their respective chain pin facing sides, or one component has permanently attached bolts capable of traversing the bores on the other component which are then secured by nuts. In these embodiments, the first component and the second component, which make up the split carrier block, are movable with respect to each other in an open position wherein they are not in contact with the chain pin. In other mechanisms, they are interlocking. Still further, bushings of various materials can be added at the interface of the chain pin and the split carrier to reduce fiction and increase wear life. The bushings can be metal or non-metal materials and, in various embodiments, can be either removable or could be added after the interface of the split carrier block wears beyond its required tolerances.

Generally, both halves are movable to a fixed position to engage chain components. Further, the halves are moveable with respect to each other to an open position to engage the chain components. The halves are moveable to a fixed position with respect to each other so that they can be affixed together and be affixed to the chain components.

In still further embodiments pertaining to the split carrier block, the block is capable of being mountable and removable from chain components of coiled tubing injector chains, generally without disassembling the coiled tubing injector chains.

Still further in the aforementioned embodiments, there is a third component which is a gripper component. The outside face of the second component, which faces the coiled tubing, is adapted to receive or to otherwise attach to the gripper component. The gripper component has a face or groove facing the coiled tubing that grips the coiled tubing and aids in the pulling or pushing of said tubing for downhole operations. The second component is secured to the third component by bolts, screws, pins, and the like. It is contemplated that any of the methods used to secure the first component to the second component can likewise be used to secure the gripper component to the second component. However, in certain embodiments, the gripper component and the second component form a unitary component where these components are forged, cast, welded, or milled together.

A further embodiment provides a method by which the split carrier blocks, namely the first and second component, are attached as two separate pieces and are affixed to the chains. The two separate pieces can be preassembled and alternatively or additively can be pre-stressed. This method results in surrounding the chain pin components and then affixing the split carrier block pieces to the coiled tubing injector head chains. This method generally results in surrounding the chain pin components and then affixing the pieces together with fasteners suitable for this purpose.

In still further embodiments concerning the first and second components, the faces of these components which face and interact with the chain pins are parallel to each other when secured. In other embodiments, the faces are diagonal to each other when secured. One possible advantage, in certain applications, of having the faces diagonal to each other is that stress from the chain pin is not uniform over the entire section.

EXAMPLES

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present invention, appreciate that many changes can be made in the specific embodiments which are disclosed and still obtain a like or similar result without departing from the spirit and scope of the invention.

Referring to FIGS. 1-6, there is a gripper receiving carrier block half 2 with chain pin grooves 3. Further seen in the gripper receiving carrier block half 2 is a plurality of carrier block bores 4 extending from the chain pin face 5 to the gripper mounting face 6. Likewise, extending through the bearing mount carrier block half are carrier block bores 4 extending from the bearing mounting face 8 to the chain pin face 5. These allow attachment of the gripper receiving carrier block half 2 to the bearing mount carrier block half 1 with bolts 11 and the like through the carrier block bores 4.

Still referring to FIGS. 1-6, the bearing mount carrier block half 1 has a chain pin face 5 capable of aligning with the gripper receiving carrier block half 2. The bearing mount face is adapted to receive, in this embodiment, bearings used for the injector chain. Additionally, the bearing mount face 8 comprises bearing mounts 9 which are depicted as being perpendicular to the axial orientation of the chain pin grooves 3. When properly aligned, the chain pin grooves 3 extend the length of the split carrier block 7. After alignment over injector head chain pins (not shown), the gripper receiving carrier block half 2 and the looped carrier block half 1 are secured or locked together with bolts 11 and the like through the carrier block bores 4.

Figure 5:
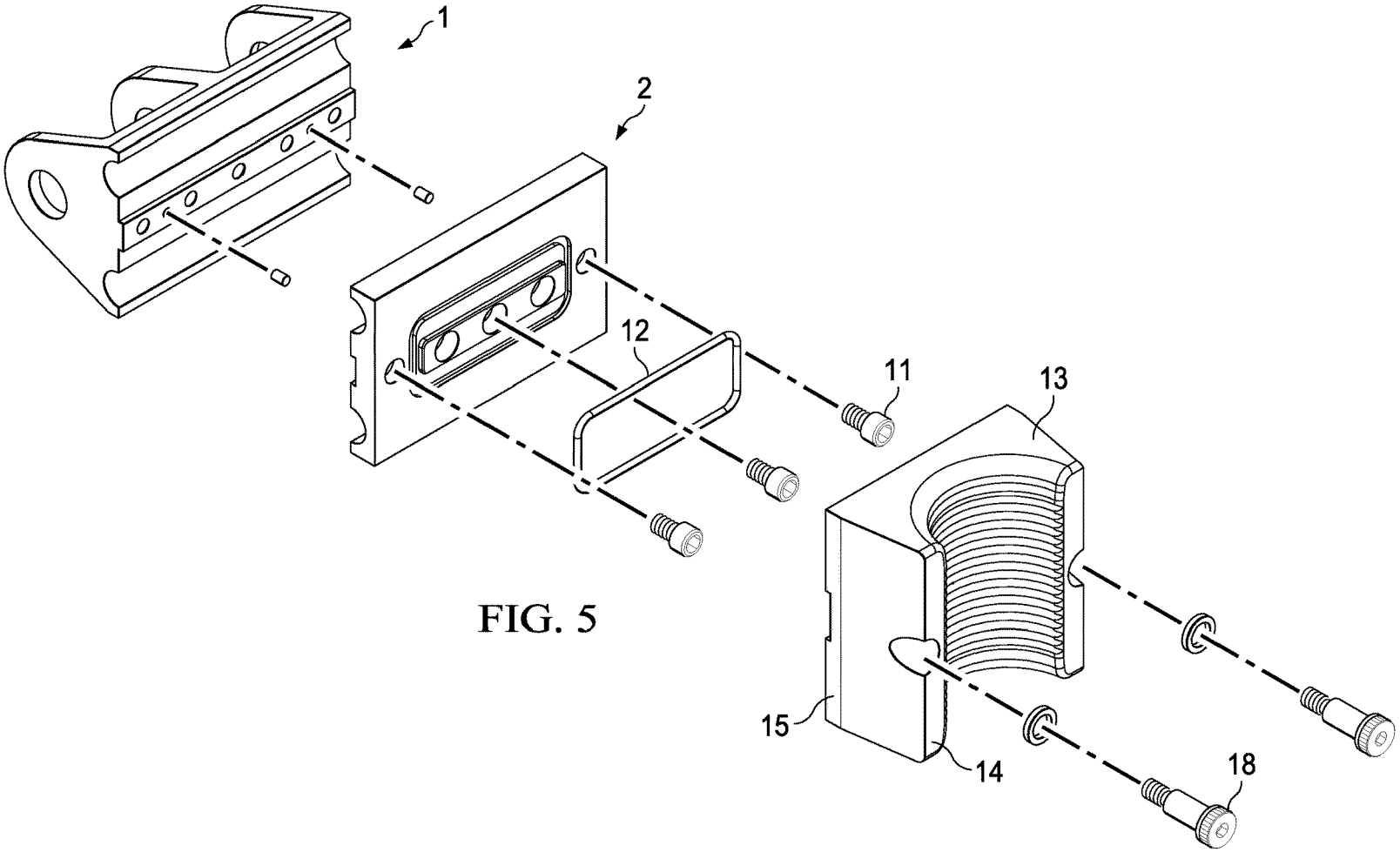
FIG. 5 is an exploded perspective view of the split carrier block from FIG. 1 including a gripper segment.
Figure 6:
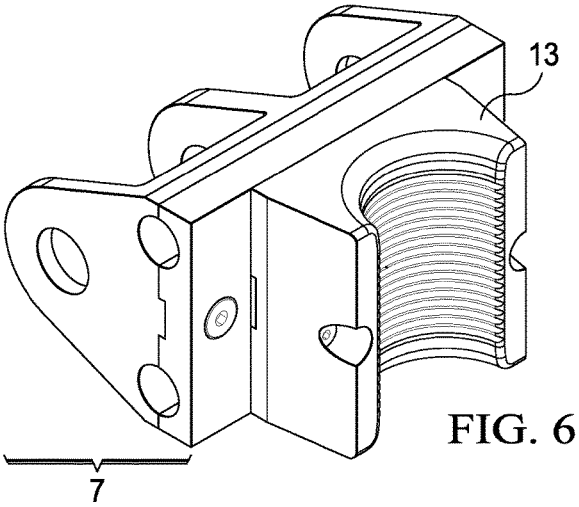
FIG. 6 is a perspective view of a split carrier block with gripper in accord with one possible embodiment of the present invention.

In yet another embodiment, as seen in FIGS. 5 and 6, the gripper 13 is a third component which attaches to the gripper mounting face 6 of the gripper receiving block half 2. In this particular embodiment, between the gripper mounting face 6 and the gripper 13 is an gasket 12 for vibration dampening and contamination impingement. As further seen in FIGS. 5 and 6, the gripper 13 has a coiled tubing side 14, and a carrier block side 15. Still further, the gripper is pictured as attached to the split carrier block 7 via bolts 18.

Figure 7A:
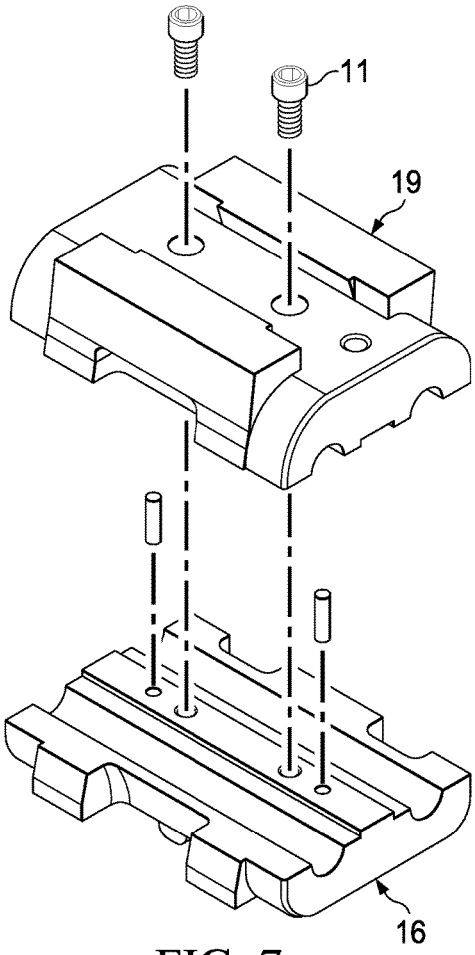
FIG. 7*a* is a disassembled view of carrier blocks showing a mounting area for a gripper.
Figure 7B:
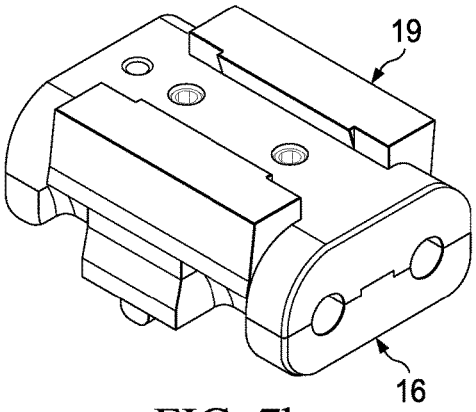
FIG. 7*b* is an assembled view.

As seen in FIGS. 7*a* and 7*b*, is an illustration of a non-gripper receiving carrier block half 16 facing a gripper receiving carrier block half 2. In this embodiment, the gripper (not shown) has yet to be bolted to the split carrier block. FIG. 7*b* illustrates the assembled view.

Figure 8A:
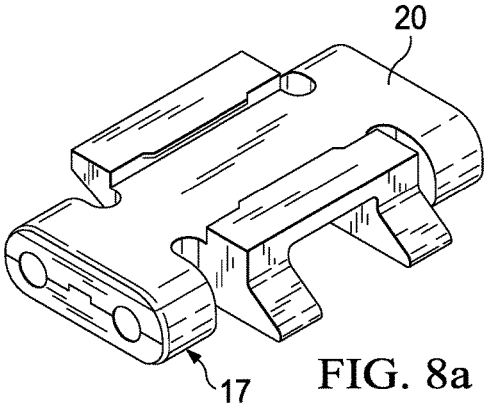
FIG. 8*a* is an illustration of a split carrier block with three pieces for chain pins that do not go completely through the carrier block of the present invention and FIG. 8*b* is an alternate illustration demonstrating that the carrier block can be assembled in more than three pieces.

FIG. 8*a* illustrates another embodiment wherein at least three components are used for chain pins which do not go all the way through the split carrier block. In certain instances, the chain pins do not connect one side of the carrier block to another side of the carrier block. In this instance, while there is still a gripper receiving carrier block half 2, the chain pins are secured by this aforementioned component, along with two short pin carrier block components 17, one on each end.

Figure 8B:
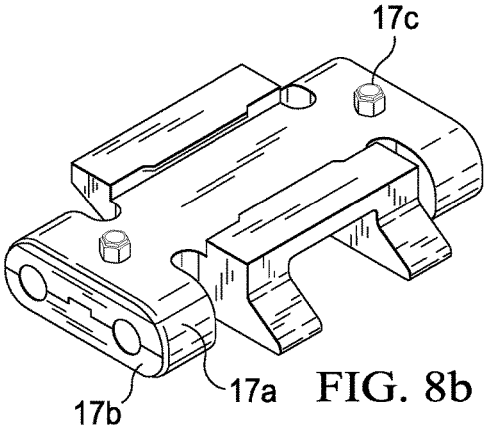
Figure 9:
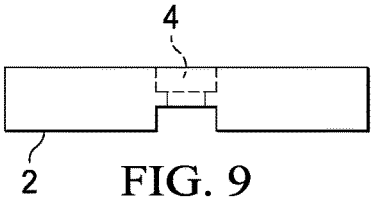
FIG. 9 is a side elevational view of a cross-section of the gripper receiving carrier block portion of a split carrier block of the present invention.
Figure 10:
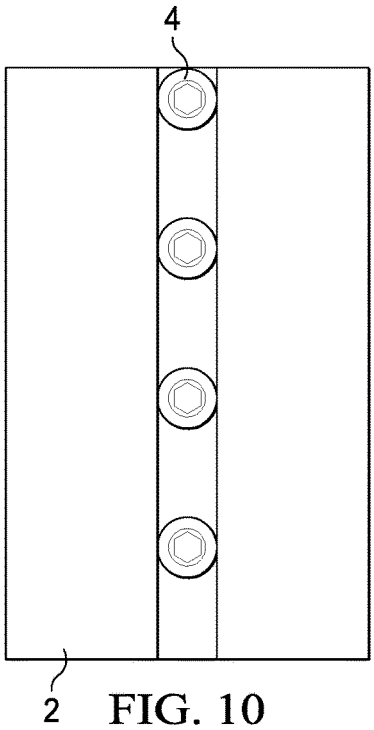
FIG. 10 is a bottom elevational view of the gripper receiving carrier block portion of a split carrier block of the present invention.
Figure 11:
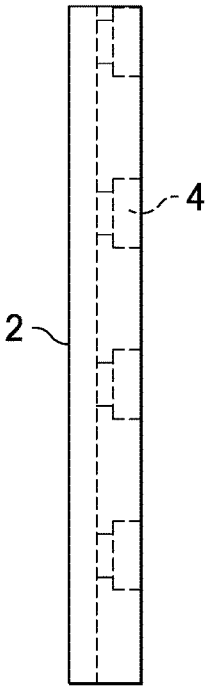
FIG. 11 is a side view of a cross-section of the gripper receiving carrier block portion of a split carrier block of the present invention.
Figure 12:
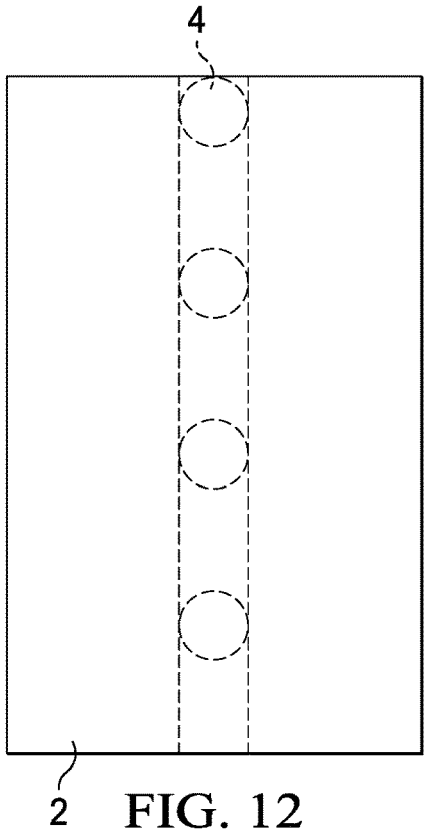
FIG. 12 is a top view of the split carrier block.
Figure 13:
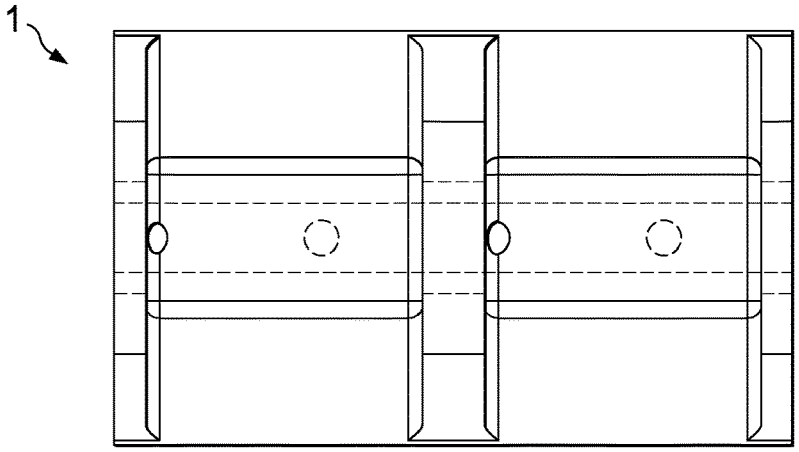
FIG. 13 is a top view of the bearing mount carrier block portion of a split carrier block of the present invention.
Figure 14:
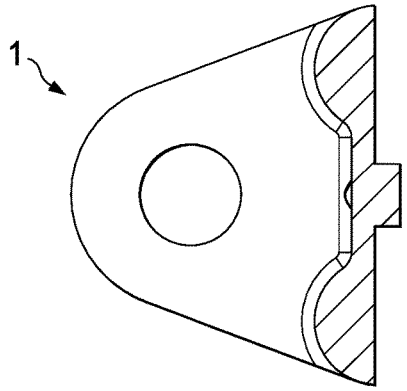
FIG. 14 is an end elevational view of the bearing mount carrier block portion of a split carrier block of the present invention.
Figure 15:
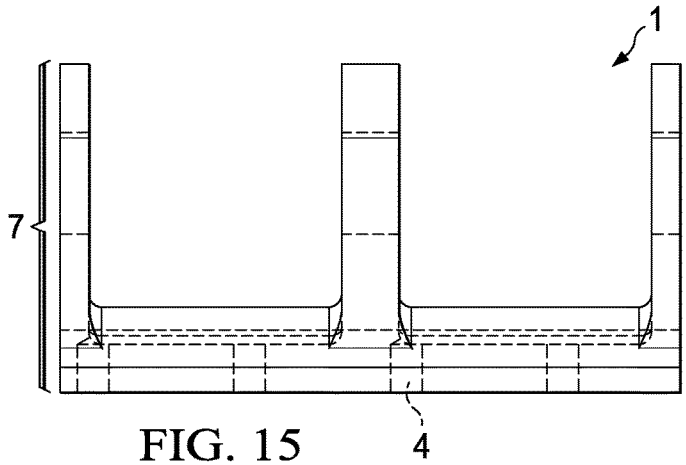
FIG. 15 is a side elevational view of the bearing mount carrier block portion of a split carrier block of the present invention.
Figure 16:
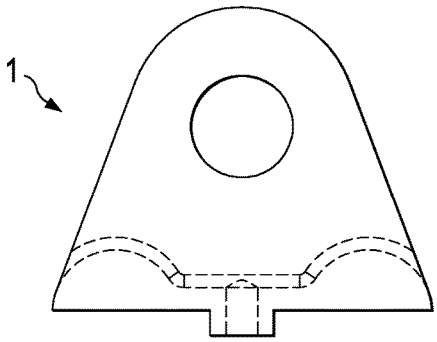
FIG. 16 is an end elevational view of the bearing mount carrier block portion of a split carrier block of the present invention.

While FIG. 8*a* is an illustration for a carrier block for use with chain pins that do not go all the way through the carrier block, the concept of multiple components making up a carrier block is contemplated by the disclosure herein. While FIG. 8*a* contains two short pin carrier block components and a gripper receiving carrier block half, such that this illustration has three components, the carrier block system can have many different components to achieve the same goal of assembling carrier blocks on chain pins. In some instances, the chain pins do not go all the way through the carrier block, in other instances the chains do go all the way through the carrier block. As seen in FIG. 8*b* for example, the gripper receiving carrier block can comprise three or more components itself. In this case, there could be a first short pin carrier block component 17*a* and a second short pin carrier block component 17*b* on either side of the gripper receiving carrier block half 2. Then the two components on each side can be secured to the gripper receiving carrier block half with a hex screw 17*c* for example, thus making a carrier block of five components.

From the foregoing description, one of ordinary skill in the art can easily ascertain the essential characteristics of this invention, and without departing from the spirit and scope thereof, can make various changes and modifications to adapt the invention to various usages and conditions. For example, we do not mean for references such as above, below, left, right, and the like to be limiting but rather as a guide for orientation of the referenced element to another element. A person of skill in the art should understand that certain of the above-described structures, functions, and operations of the above-described embodiments are not necessary to practice the present invention and are included in the description simply for completeness of an exemplary embodiment or embodiments. In addition, a person of skill in the art should understand that specific structures, functions, and operations set forth in the above-described referenced patents and publications can be practiced in conjunction with the present invention, but they are not essential to its practice.

The invention can be embodied in other specific forms without departing from its spirit or essential characteristics. A person of skill in the art should consider the described embodiments in all respects only as illustrative and not restrictive. The scope of the invention is, therefore, indicated by the appended claims rather than by the foregoing description. A person of skill in the art should embrace, within their scope, all changes to the claims which come within the meaning and range of equivalency of the claims. Further, we hereby incorporate by reference, as if presented in their entirety, all published documents, patents, and applications mentioned herein.

What is claimed is:

1. A split carrier block for use with a coiled tubing injector chain comprising:

A. a first carrier block component comprising a first chain pin component receptacle side and a bearing mount;

B. a second carrier block component comprising a second chain pin component receptacle side and a side facing the coiled tubing;

wherein the first carrier block component and the second carrier block component are capable of a releasable fixed direct connection to at least one chain pin component of the coiled tubing injector chain, wherein the coiled tubing injector chain is not disassembled during release of the first carrier block component and the second carrier block component from the at least one chain pin.

2. The split carrier block of claim 1, further comprising fasteners to affix the first carrier block component and the second carrier block component together.

3. The split carrier block of claim 2, wherein said fasteners comprise at least one of hinges, pins, rivets, threaded members, interlocking sections of said first component and said second component.

4. The split carrier block of claim 1, further comprising alignment members to align the first carrier block component and the second carrier block component.

5. The split carrier block of claim 4, wherein said alignment members comprise tongue members that mate with corresponding grooves, lap joint, pins, dowels, shoulders, overlaps or combinations thereof.

6. The split carrier block of claim 1 wherein the split carrier block comprises a gripper component with a coil tubing facing side and a side secured to the second carrier block component.

7. A coiled tubing injector comprising at least one pair of said split carrier block of claim 1.

8. At least one pair of said split carrier block of claim 1.

9. A kit comprising a split carrier block of claim 1.

10. A method of mounting or removing the split carrier block of claim 1 from coiled tubing injector chains, the method comprising:

a. providing an assembled coiled tubing injector head chain assembly; and mounting or removing said carrier block with respect to said coiled tubing injector head chain assembly;

b. affixing the split carrier block to chain pins of the coiled tubing injector head chain assembly.

11. The method of claim 10 further comprising selectively mounting a coiled tubing gripper to said carrier block.

12. The method of claim 11, wherein the split carrier block comprises the first and the second carrier block components and at least one of these two components is capable of being removed from the coiled tubing injector head chain assembly for removal of the gripper.

* * * * *